United States Patent [19]

Burkhardt

[11] Patent Number: 4,821,355

[45] Date of Patent: Apr. 18, 1989

[54] SELF-ADJUSTING ORTHOPEDIC CERVICAL PILLOW

[76] Inventor: George J. Burkhardt, 116D Cherry Park Condominiums, Park Blvd., Cherry Hill, N.J. 08002

[21] Appl. No.: 123,530

[22] Filed: Nov. 19, 1987

[51] Int. Cl.[4] ..... A47C 20/02

[52] U.S. Cl. ..... 5/434; 5/436

[58] Field of Search ..... 5/431, 434, 436, 437, 5/441

[56] References Cited

U.S. PATENT DOCUMENTS

| | | | |
|---|---|---|---|
| D. 241,700 | 10/1976 | Wattie . | |
| D. 246,626 | 12/1977 | Shenk . | |
| D. 254,029 | 1/1980 | Barbagallo . | |
| D. 276,938 | 12/1984 | Pedersen . | |
| 2,522,120 | 9/1950 | Kaskey et al. | 5/436 X |
| 3,400,413 | 9/1968 | La Grossa | 5/436 |
| 3,829,917 | 8/1974 | De Laittre et al. | 5/430 |
| 4,218,792 | 8/1980 | Kogan . | |
| 4,424,599 | 1/1984 | Hannouche . | |
| 4,447,922 | 5/1984 | Brochu | 5/434 |
| 4,528,705 | 7/1985 | Greenawalt | 5/434 X |

*Primary Examiner*—Alexander Grosz
*Assistant Examiner*—Michael F. Trettel
*Attorney, Agent, or Firm*—Charles F. Duffield

[57] ABSTRACT

An orthopedic cervical pillow is disclosed which has a substantially flat undersurface and an uppersurface contoured to form a back engaging portion transitioning into a convex neck engaging portion further transitioning into a head engaging portion. Self-adjusting lift of the back and neck engaging portions is accomplished by means of a relieved section in the undersurface of the pillow generally beneath the head engaging portion. The relieved section extends entirely across the width of the pillow and extends from a forwardmost point underneath the neck engaging portion to approximately halfway under the head engaging portion wherein the contour of the relieved section assumes a substantially vertical contour at its rearmost portion.

4 Claims, 1 Drawing Sheet

SELF-ADJUSTING ORTHOPEDIC CERVICAL PILLOW

BACKGROUND OF INVENTION

The present invention relates to an orthopedic cervical pillow and, more specifically, to an orthopedic cervical pillow of the type which has self-adjusting features to apply the appropriate pressure to the upper back and neck to maintain the appropriate lordotic curve.

The human neck is one of the most vital structures of the human body. The neck houses and protects the spinal cord, which relays all major bodily functions to and from the brain. The neck is composed of 7 vertebrae and interconnecting ligaments. Cushioned between the vertebrae and ligaments are the intervertebral discs which separate the vertebrae and serve as mini shock absorbers. The delicate spinal cord is situated just behind the vertebrae, housed in its own spinal canal.

The neck structure of the human body may be injured in many ways. Muscles and ligaments can be sprained or strained. The intervertebral discs can become herniated and impinge upon delicate nerve tissue. Neck injuries usually result in intensive pain.

One means of maintaining the neck structure healthy and/or to relieve pain subsequent to an injury to the neck is to maintain that special curvature of the neck known as the lordotic curve. This curve, often referred to as the backward letter "C", shape of the neck keeps the vertebral body in optimal alignment and the intervertebral foramen most open to allow spinal nerves the maximum space. In this manner, pinching of nerves with its consequent pain is reduced as well as wear and tear on the discs which aid in limiting herniating of the discs.

The common bed pillow generally used for head support during sleep is a device generally filled with such material as down or foam rubber in a loose format and contained within a pillow casing. Such a pillow may be adjusted or "plumped" by the user to assume an initial contour or configuration to the liking of the user. However, after a very short period of time, this configuration readily dissipates in that the pillow does not have any preformed contour or configuration. Such pillows provide little or no therapeutic support.

An orthopedic cervical pillow to be at all effective must provide controlled and maintainable support for the critical neck portion of the body. Such a pillow should also provide for upper back support as well as head support working in combination to provide the required contour maintenance for the entire upper back, neck and head of the body in order to maintain the critical lordotic curve.

Orthopedic cervical pillows do exist in the prior art which are generally made of a form maintaining and resilient composition which provides for upper back, neck and head support. Examples of such pillows are shown in U.S. Pat. Nos. 4,424,599, Des. 246,626, Des. 254,029 and Des. 276,938.

Orthopedic cervical pillows of the prior art, while providing generally upper back, neck and head support, do so in somewhat of a rigid and inflexible manner. More specifically, the particular contour of these prior art pillows is fixed basically by the contour of the pillow when purchased and is not adjustable to accommodate varying human features such as the size and weight of a given individual utilizing the pillow. Accordingly, these pillows are more or less of an approximation in the support that they provide and may give too little neck support for one individual due to that individual's particular anatomical pecularities while giving too great of neck pressure in the critical area for the next using individual. Such prior art devices do not provide a self-adjusting neck pressure feature which will accommodate varying anatomical differences from one user to the other to adjust the upper back and neck pressures required for that particular user.

SUMMARY OF INVENTION

The orthopedic cervical pillow of the present invention is composed of a resilient form maintaining cellular material and is of an overall configuration having an undersurface and an uppersurface. The uppersurface is contoured to form a back engaging portion which transitions into a convex neck engaging portion which likewise transitions into a head engaging portion.

The orthopedic cervical pillow of the present invention provides a self-adjusting equal action-reaction feature for adjusting the pressure upon the upper back and neck portion of the pillow as required to suit the requirements of the upper back and neck of the user by the utilization of a relieved section in the undersurface of the pillow generally beneath the head engaging portion of the pillow and extending uniformly across the entire width of the pillow. The relieved section extends from its foremost position from a point beneath the neck engaging portion rearwardly to a point approximately halfway beneath the head engaging portion. The relieved section at its rearmost point terminates in a substantially vertical contour to the undersurface of the pillow.

DETAILED DESCRIPTION OF INVENTION

Figure 1:
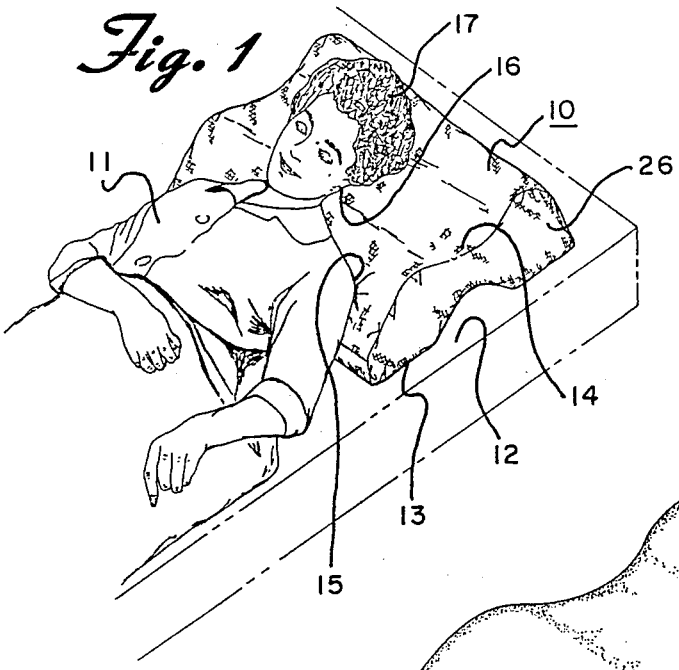
FIG. 1 is a perspective view of the orthopedic pillow of the present invention illustrating the pillow in use.

The orthopedic pillow of the present invention is shown in FIGS. 1–4 of the drawing. Reference will be made to FIGS. 1–4 generally with specific reference to a given figure as particularly required.

FIG. 1 illustrates the orthopedic pillow 10 in use by an individual 11. The pillow is designed for use in conjunction with a structure such as a bed 12. The pillow includes an undersurface 13 and an uppersurface 14 which provide support for the upper back 15, neck 16 and head 17 of the user.

Figure 2:
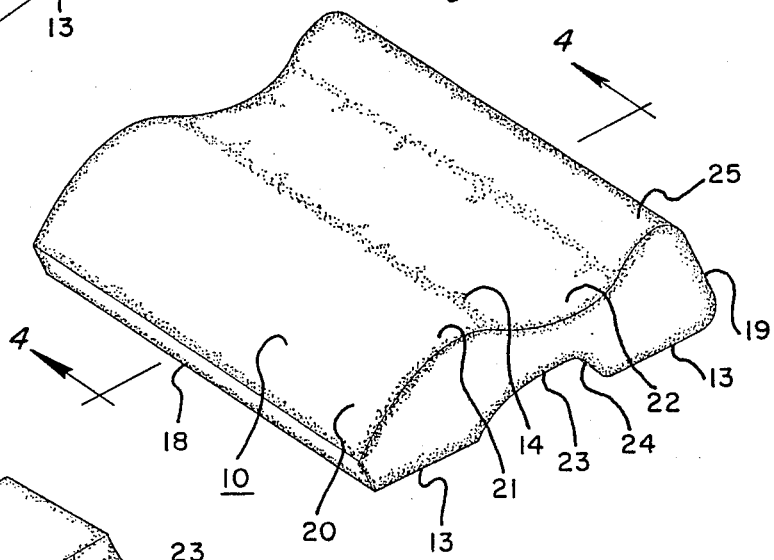
FIG. 2 is a perspective view of the orthopedic pillow of the present invention illustrating the uppersurface contour thereof.
Figure 3:
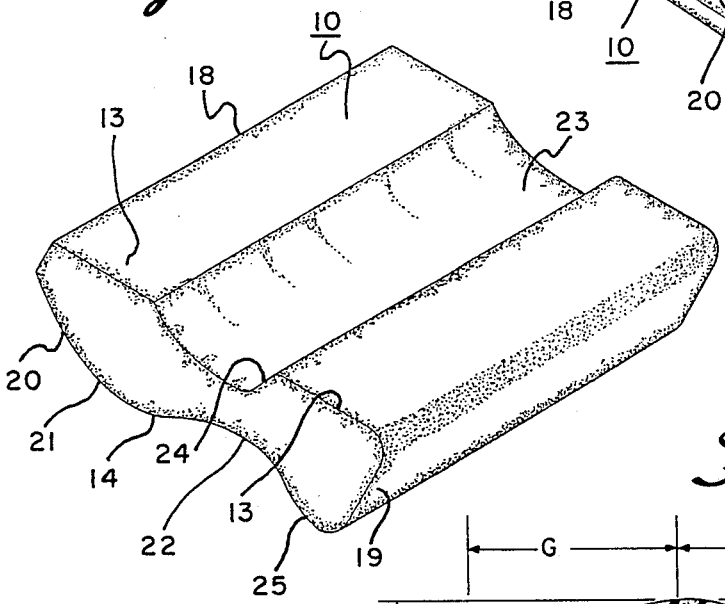
FIG. 3 is a perspective view of the orthopedic pillow of the present invention illustrating the undersurface contour thereof.
Figure 4:
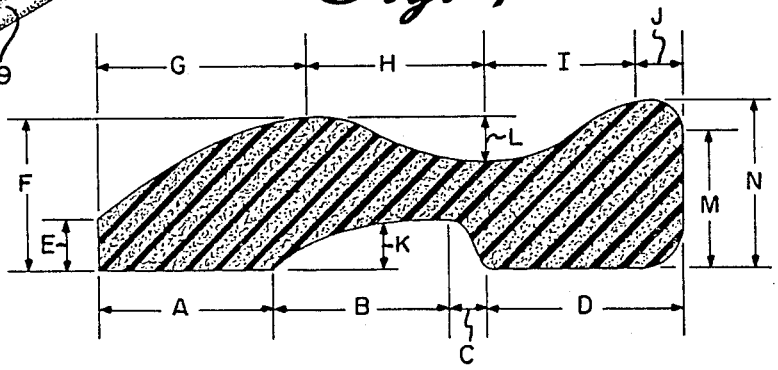
FIG. 4 is a cross-sectional view of the orthopedic pillow of the present invention taken along the lines 4—4 of FIG. 2.

Referring particularly to FIGS. 2–4 of the drawing, the pillow 10 is shown with its pillowcase 26 removed. The pillow is preferably formed of a form maintaining resilient cellular material such as foam rubber, polyurethane latex or other similar materials. The general width and depth of the pillow 10 is approximately that of an ordinary bed pillow.

The uppersurface 14 of the pillow is of a very specific contour. Beginning from the forwardmost portion 18 of the pillow toward the rearmost portion 19 thereof, the pillow includes a first shoulder engaging portion 20 which begins at the forwardmost portion 18 slightly above the undersurface 13 and rises gently upwardly until reaching a convex neck engaging portion 21. The pillow contour transitions gently from the shoulder engaging portion 20 into the neck engaging portion 21.

The convex neck engaging portion 21 continues from its transition point with the shoulder engaging portion 20 over the crest of the convex configuration downwardly into the opposite side thereof into a transition point with a concave head engaging portion 22.

The concave head engaging portion 22 continues toward the rearmost portion 19 of the pillow through the bottom of the concave configuration upwardly to its terminus at the rearmost portion 19 of the pillow.

The specific cross section of the contour of the orthopedic pillow of the present invention as respects the uppersurface thereof showing the transition of the upper shoulder engaging portion 20 into the convex neck engaging portion 21 and further into the concave head engaging portion 22 is shown specifically in FIG. 4 of the drawing. This uppersurface contour of the orthopedic pillow of the present invention extends uniformly throughout the entire width of the pillow.

In accordance with the present invention as specifically shown in FIGS. 2–4 of the drawing, the orthopedic pillow of the present invention includes a relieved section 23 formed in the undersurface 13 of the pillow. The relieved section 23, as in the case of the uppersurface, extends uniformly throughout the entire width of the pillow.

The relieved section 23 is positioned generally underneath the head engaging portion 22 formed in the uppersurface 14 of the pillow. The relieved section 23 extends in its direction toward the foremost portion 18 of the pillow to a point generally midway underneath the neck engaging portion 21 of the pillow. The relieved section 23 likewise extends in the opposite direction toward the rearmost portion 19 of the pillow to a point approximately halfway underneath the head engaging portion 22 of the pillow. At this point, the contour of the relieved section 23, in the direction of the rearmost portion 19, terminates in a substantially vertically contour portion 24 in the direction of the undersurface 13 of the pillow 10.

In use as the individual utilizing the pillow places their upper back, neck and head upon the pillow, the relieved section 23 of the pillow will permit downward flexure of the uppersurface 13 of the pillow. As this occurs, the back engaging portion 20 and neck engaging portion 21 of the uppersurface of the pillow will generally rise upwardly in proportional action-reaction response to the application of pressure upon the pillow by the head 17 of the user in a manner to apply increasing proportional pressure to the back portion and particularly to the neck portion of the individual user. To a lesser degree, the application of head pressure to the head engaging portion of the pillow and operating through the relieved section 23 of the pillow further in conjunction with the vertical contour section 24 thereof will apply an uplifting proportional action-reaction pressure to the rearmost portion 25 of the head engaging portion 22 of the pillow. In this manner, varying anatomical differences of the pillow user including physical dimensions and weight will be automatically adjusted and compensated for to provide the necessary neck and upper shoulder pressures required for the appropriate therapeutic support.

Illustrated in FIG. 4 by letter are various dimensions of the cross section of the pillow. The chart set out below sets forth specific dimensions for the various portions of the pillow illustrated in FIG. 4 by letter which has been found to be satisfactory in one embodiment of the orthopedic pillow of the present invention.

| TABLE OF DIMENSIONS | |
|---|---|
| A | 5" |
| B | 5½" |
| C | ½" |
| D | 5½" |
| E | 1" |
| F | 4½" |
| G | 6½" |
| H | 4½" |
| I | 4½" |
| J | 1" |
| K | 1½" |
| L | 2" |
| M | 4" |
| N | 5". |

The above dimensions may vary and accordingly, no limitation as to the scope of the invention is intended by the statement herein of specific dimensions of a given embodiment of the orthopedic pillow of the present invention.

The orthopedic cervical pillow of the present invention has been described in respect to a particular embodiment thereof set forth in the foregoing specification and as illustrated in the accompanying drawing. Other variations and modifications of the orthopedic cervical pillow of the present invention are possible and may be suggested to those skilled in the art by reason of the foregoing disclosure and, accordingly, no limitation as to the scope of the invention is intended by the disclosure of the specific embodiment set forth herein and the scope of the present invention is to be interpreted in view of the appended claims.

What is claimed is:

1. In an orthopedic cervical pillow formed of resilient form maintaining cellular material of the type having an undersurface and an uppersurface contoured from front to rear to form a in depth back engaging portion transitioning into a convex neck engaging portion further transitioning into a head engaging portion, the improvement providing for self-adjusting lift of the back and neck engaging portions proportionally responsive to the user's head pressure upon the head engaging portion comprising:

a relieved section within the undersurface of the pillow generally beneath the head engaging portion extending from underneath the head engaging portion in a direction toward the rear of the pillow to end at a point under and no more than approximately half the depth of the head engaging portion toward the rear of the pillow and furthe extending in a forward direction to a region beneath the neck engaging portion of the pillow whereby, upon a user's head applying pressure upon the head engaging portion, such pressure will proportionately compress the recess downwardly providing adjustment upwardly of the neck and back engaging portions of the pillow.

2. The pillow of claim 1 wherein the relieved section, at its rearmost point beneath the head engaging portion, terminates in a substantially vertical contour.

3. The pillow of claim 2 wherein the relieved section is of uniform cross section across the entire width of the pillow.

4. The pillow of claim 1 wherein the relieved section is of uniform cross section across the entire width of the pillow.

* * * * *